US005229237A

United States Patent [19]

Kawamorita et al.

[11] Patent Number: 5,229,237

[45] Date of Patent: Jul. 20, 1993

[54] ELECTROPHOTOGRAPHIC PHOTOSENSITIVE MEMBER AND PROCESS FOR PRODUCTION THEREOF COMPRISING A DISAZO AND TRISAZO PIGMENT

[75] Inventors: Yoichi Kawamorita, Yokohama; Hisao Maruyama, Kamakura; Kazushige Nakamura, Yokohama, all of Japan

[73] Assignee: Canon Kabushiki Kaisha, Tokyo, Japan

[21] Appl. No.: 683,192

[22] Filed: Apr. 10, 1991

[30] Foreign Application Priority Data

Apr. 12, 1990 [JP] Japan ..... 2-095078

[51] Int. Cl.[5] ..... G03G 5/06

[52] U.S. Cl. ..... 430/73; 430/78; 430/58

[58] Field of Search ..... 430/58, 59, 73, 76, 430/78

[56] References Cited

U.S. PATENT DOCUMENTS

| | | | |
|---|---|---|---|
| 4,427,753 | 1/1984 | Fujimura et al. | 430/59 |
| 4,471,040 | 9/1984 | Katagiri et al. | 430/59 |
| 4,810,607 | 3/1989 | Matsumoto et al. | 430/73 |
| 4,868,080 | 9/1989 | Umehara et al. | 430/73 |
| 4,932,860 | 6/1990 | Yoshihara et al. | 430/83 |
| 4,956,255 | 9/1990 | Ueda | 430/59 |

FOREIGN PATENT DOCUMENTS

| | | |
|---|---|---|
| 57-104145 | 6/1982 | Japan . |
| 60-73540 | 4/1985 | Japan . |
| 63-38942 | 2/1988 | Japan . |
| 63-44661 | 2/1988 | Japan . |
| 63-313163 | 12/1988 | Japan . |
| 1-27305 | 10/1989 | Japan . |
| 1484927 | 9/1977 | United Kingdom . |
| 2088575 | 6/1982 | United Kingdom . |

*Primary Examiner*—Marion E. McCamish
*Assistant Examiner*—S. Rosasco
*Attorney, Agent, or Firm*—Fitzpatrick, Cella, Harper & Scinto

[57] ABSTRACT

An electrophotographic photosensitive member is produced by coating an electroconductive substrate with a compound represented by formula (1) shown below and a compound represented by formula (2) shown below respectively by spray-coating through separate spraying means to form a photosensitive layer containing the compounds represented by the formulae (1) and (2) respectively on the electroconductive substrate:

Formula (1)

Formula (2)

-continued

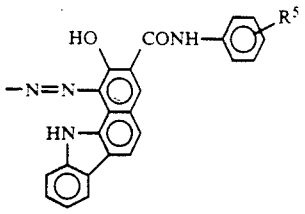

In the above formulae (1) an (2), $Ar_1$ and $Ar_2$ independently denote an aromatic hydrocarbon ring which may have a substituent, a heterocyclic aromatic ring which may have a substituent, or a ring assembly formed by bonding the aromatic rings directly or through an aromatic or non-aromatic bonding group; and $R_1$–$R_5$ independently denote hydrogen atom, halogen atom, alkyl group, alkoxy group, nitro group or cyano group.

10 Claims, 1 Drawing Sheet

ELECTROPHOTOGRAPHIC PHOTOSENSITIVE MEMBER AND PROCESS FOR PRODUCTION THEREOF COMPRISING A DISAZO AND TRISAZO PIGMENT

FIELD OF THE INVENTION AND RELATED ART

The present invention relates to an electrophotographic photosensitive member, more particularly an electrophotographic photosensitive member having a photosensitive layer comprising at least two specific compounds, and a process for producing such an electrophotographic photosensitive member.

Since it was discovered that specific organic compounds show photoconductivity, there have been developed heretofore a large number of organic photoconductors, examples of which may include: organic photoconductive polymers, such as poly-N-vinylcarbazole and polyvinylanthracene; low-molecular weight organic photoconductors, such as carbazole, anthracene, pyrazolines, oxadiazoles, hydrazones and arylalkanes; and organic pigments or dyes, such as phthalocyanine pigments, azo pigments, cyanine pigments, polycyclic quinone pigments, perylene pigments, indigo dyes, thioindigo dyes and squaric acid methine dyes.

Particularly, many photoconductive, organic pigments and dyes have been proposed as charge generating substances for photosensitive members, because they can be synthesized easier and at a lower production cost than inorganic substances and an enlarged variation of compounds thereof can be used.

In recent years, in compliance with requirements for a prolonged durability life, and a further improved image forming characteristic for a photosensitive member, durability against a rest memory phenomenon has raised attention in addition to the conventional characteristics, such as high sensitivity and high durability required of a charge generating substance. Herein, the "rest memory phenomenon" is a kind of deterioration caused by a corona discharge product and more specifically refers to a phenomenon which occurs, when the rotation of a photosensitive member is terminated after a copying operation. A part of the photosensitive member in the vicinity of a corona charger is caused to have a lowered chargeability, thus resulting in an image having a lowered image density in case of normal development or an increased image density in case of reversal development at the corresponding part in a subsequent copying operation. This phenomenon is liable to occur after a photosensitive member has been used for a long time and becomes a more serious problem as the life of a photosensitive member is prolonged.

Further, organic photoconductive substances allow a relatively high latitude in molecular designing and spectral sensitivity designing, but not many organic photoconductive substances show a sufficient sensitivity to semiconductor laser light having an oscillating wavelength in the neighborhood of 780–800 nm used in laser beam printers, laser facsimile apparatus, etc., which have recently been called to particular attention, and the spectral sensitivity region thereof has been restricted.

For example, in order to design an electrophotographic photosensitive member which is required to show a combined function applicable to both a plain paper-copying machine and a laser beam printer or laser beam facsimile apparatus, such a photosensitive member is required to show a broad and sufficiently large spectral sensitivity covering from a visible region in the neighborhood of 400 nm up to a near infrared region in the neighborhood of 800 nm which is a semiconductor laser wavelength region. It is however very difficult for a single charge generating substance to show such a spectral sensitivity characteristic.

Accordingly, it has been proposed to use a combination of plural charge generating substances showing sensitivities in different wavelength regions, such as a substance showing an excellent sensitivity to a visible region and a substance showing an excellent sensitivity to longer wavelength light, e.g., in GB-A 1484927, but it has been very difficult to place plural substances in a suitable mixing state within a photosensitive layer in the following respects.

A photosensitive layer is generally formed by applying a coating liquid comprising an organic photoconductive substance, a binder resin, a solvent, etc., onto an electroconductive substrate. In case where two or more charge generating substances are co-present in a single coating liquid, these charge generating substances are liable to agglomerate due to a difference in (zeta) potential between the respective substances to causes which either precipitation or a crystal modification because they require différent solvents as suitable, so that it has been difficult to retain all the charge generating substances co-present in a stable state.

In the case where a coating liquid is provided for each charge generating substance and the respective coating liquids are applied sequentially by dipping (dip coating), a lower charge generation layer is liable to be dissolved depending on the binder resin and solvent used, thus failing to provide stable electrophotographic characteristics.

Further, in the case where a curable or setting resin is used for constituting a layer containing a charge generating substance in order to obviate the above problem, there are accompanied several difficulties, such that the curing (formation of a three-dimensional structure) of the resin is difficult due to the presence of the charge generating substance therein, a high resistivity results to provide an inferior electrophotographic characteristic, and an inferior electrophotographic characteristic results also when a curing agent is contained.

SUMMARY OF THE INVENTION

An object of the present invention is to provide an electrophotographic photosensitive member showing stable electrophotographic performances over a wide range from a short wavelength region to a long wavelength region.

Another object of the present invention is to provide an electrophotographic photosensitive member showing an excellent durability against a photo-memory and a rest memory.

According to the present invention, there is provided an electrophotographic photosensitive member, comprising: an electroconductive substrate and a photosensitive layer disposed on the electroconductive substrate, wherein the photosensitive layer contains a compound represented by formula (1) below and a compound represented by formula (2) below and has been formed by applying the compounds (1) and (2) respectively by spray-coating through separate spraying means:

Formula (1)

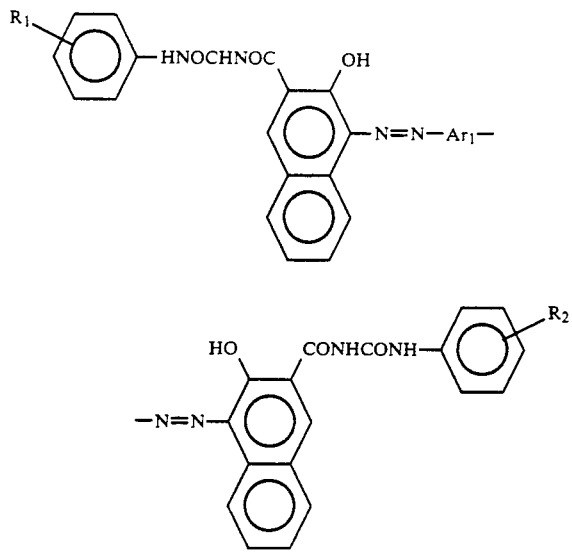

wherein $Ar_1$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_1$ and $R_2$ independently denote hydrogen atom, halogen atom, alkyl group, alkoxy group, nitro group or cyano group;

Formula (2)

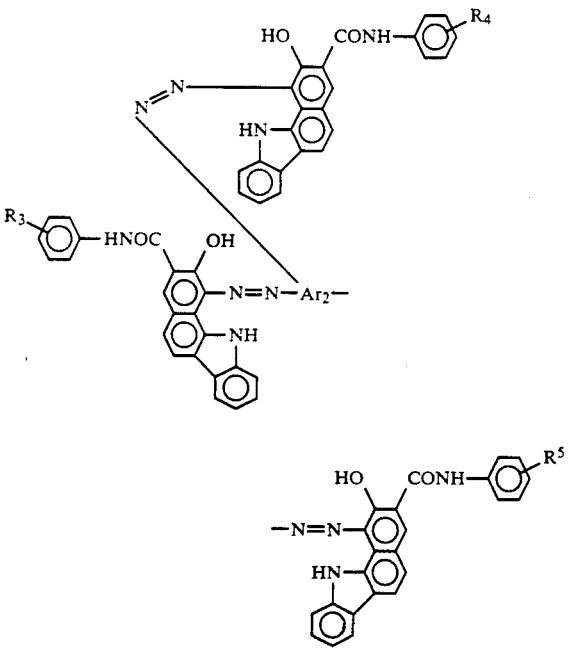

wherein $Ar_2$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_3$, $R_4$ and $R_5$ independently denote hydrogen atom, halogen atom, alkyl group, alkoxy group, nitro group or cyano group.

According to another aspect of the present invention, there is provided a process for producing an electrophotographic photosensitive member, comprising: coating an electroconductive substrate with the abovementioned compounds represented by the formulae (1) and (2) respectively by spray-coating through separate spraying means to form a photosensitive layer containing the compounds represented by the formulae (1) and (2) respectively on the electroconductive substrate.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
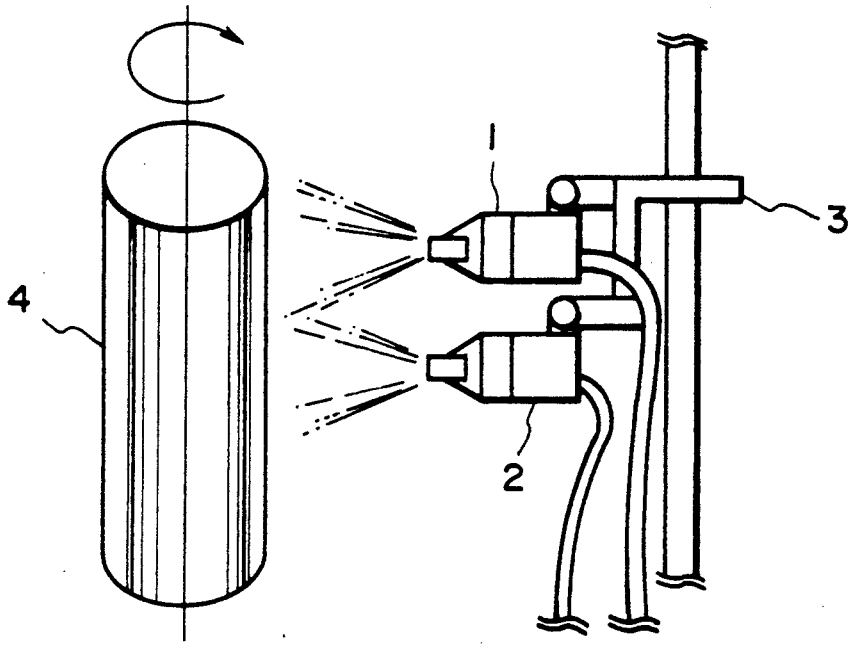
FIG. 1 illustrates an example of coating apparatus for producing an electrophotographic photosensitive member according to the invention.

The electrophotographic photosensitive member according to the present invention comprises an electroconductive substrate and a photosensitive layer disposed on the electroconductive substrate and containing compounds represented by the above-mentioned formulae (1) and (2).

In the formula (1), examples of $Ar_1$ may include: hydrocarbon-type aromatic rings, such as those of benzene, naphthalene, fluorene, phenanthrene, anthracene and pyrene; heterocyclic aromatic rings, such as those of furan, thiophene, pyridine, indole, benzothiazole, carbazole, acridone, dibenzothiophene, benzoxazole, benzotriazole, oxadiazole and thiazole; and ring assemblies formed by bonding two or more of the above-mentioned aromatic rings directly or through an aromatic or non-aromatic bonding group, such as those of triphenylamine, diphenylamine, N-methyldiphenylamine, biphenyl, terphenyl, binaphthyl, fluorenone, phenanthrenequinone, anthraquinone, benzoanthrone, diphenyloxadiazole, phenylbenzooxazole, diphenylmethane, diphenylsulfone, diphenyl ether, benzophenone, stilbene, distyrylbenzene, tetraphenyl-p-phenylenediamine and tetraphenylbenzidine.

Examples of the substituent which $Ar_1$ may have may include: alkyl groups, such as methyl, ethyl, propyl and butyl; alkoxy groups, such as methoxy and ethoxy; dialkylamino groups, such as dimethylamino and diethylamino; halogen atoms, such as fluorine, chlorine and bromine; hydroxy group, nitro group, and halomethyl groups.

Examples of $R_1$ and $R_2$ may include: halogen atoms, such as fluorine, chlorine and bromine, alkyl groups such as methyl, ethyl, propyl and butyl; alkoxy groups, such as methoxy and ethoxy; and further nitro group and cyano group.

In the above-mentioned formula (2), $Ar_2$ may have a ring or ring assembly structure similar to that of $Ar_1$ in the formula (1) described above except that $Ar_2$ assumes a trivalent group structure while $Ar_1$ assumes a divalent group structure. $Ar_2$ may also have a similar substituent to that which $Ar_1$ may have described above. Examples of $R_3$, $R_4$ and $R_5$ may include those of $R_1$ and $R_2$ described above.
Specific and non-exhaustive examples of the compound represented by the above-mentioned formula (1) may include those of the formulas shown below followed by Example Compound numbers such as (1)-1, (1)-2, etc.:
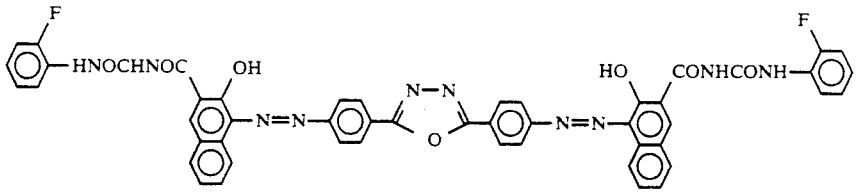
(1)-1
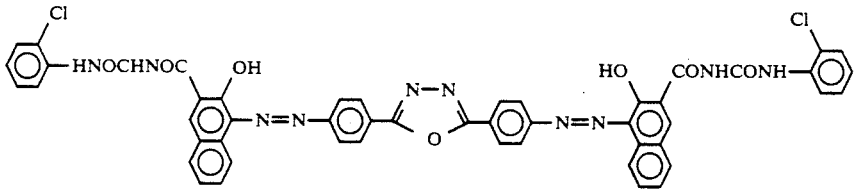
(1)-2
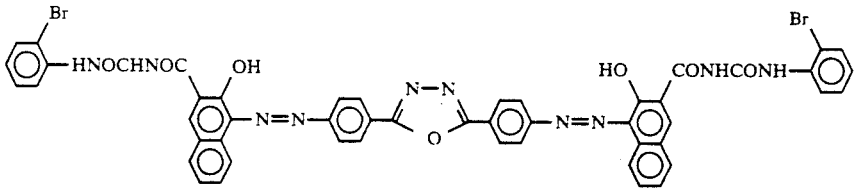
(1)-3
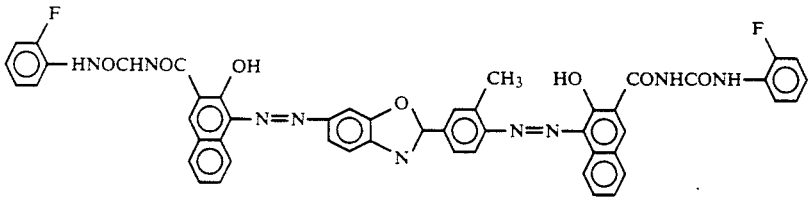
(1)-4
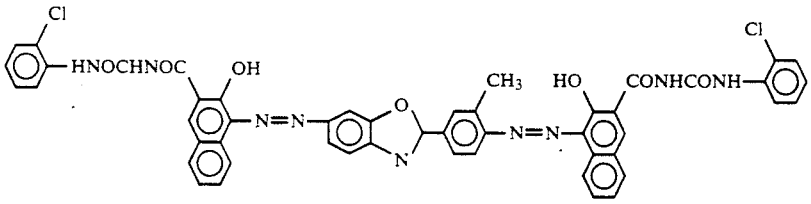
(1)-5
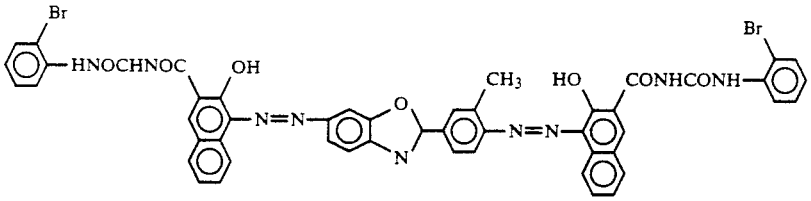
(1)-6
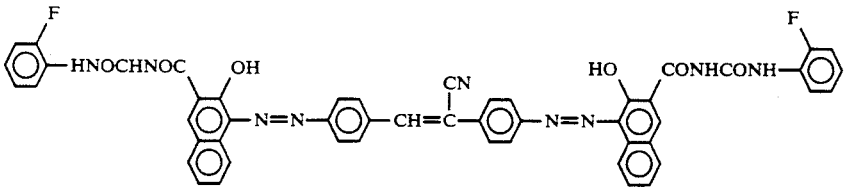
(1)-7
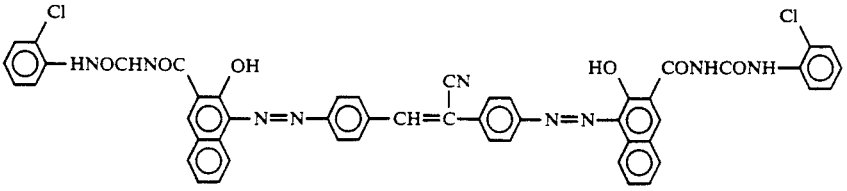
(1)-8

-continued
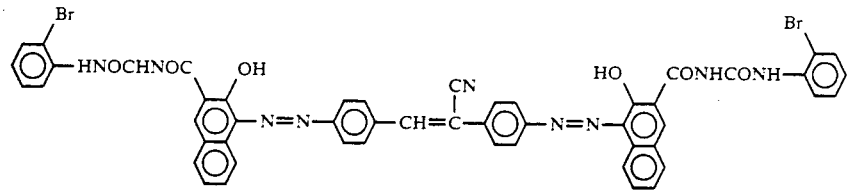
(1)-9
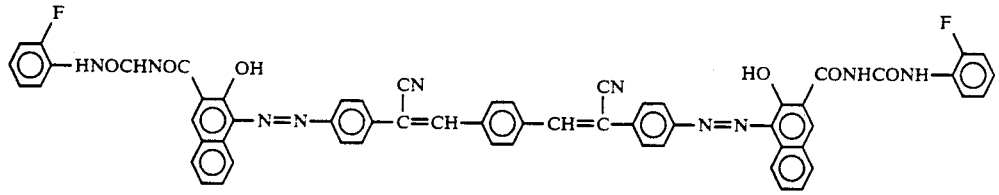
(1)-10
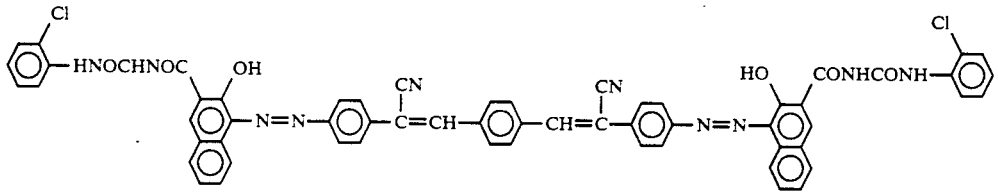
(1)-11
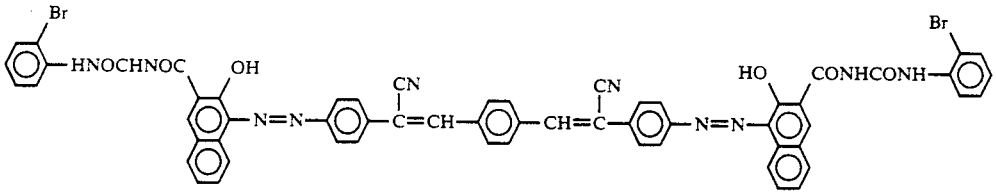
(1)-12
Among the above, Example Compounds (1)-1, (1)-2 and (1)-3 are preferred, and Example Compound (1)-2 is particularly preferred.
Specific and non-exhaustive examples of the compound represented by the above-mentioned formula (2) may include those of the formulas shown below followed by Example Compound numbers such as (2)-1, (2)-2, etc.:
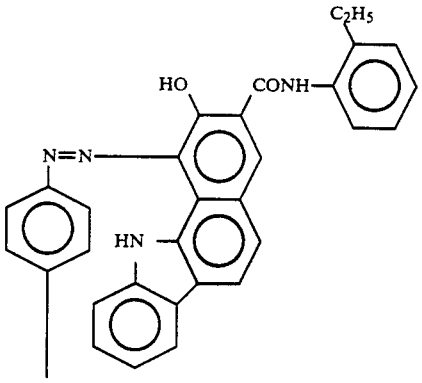
(2)-1

-continued
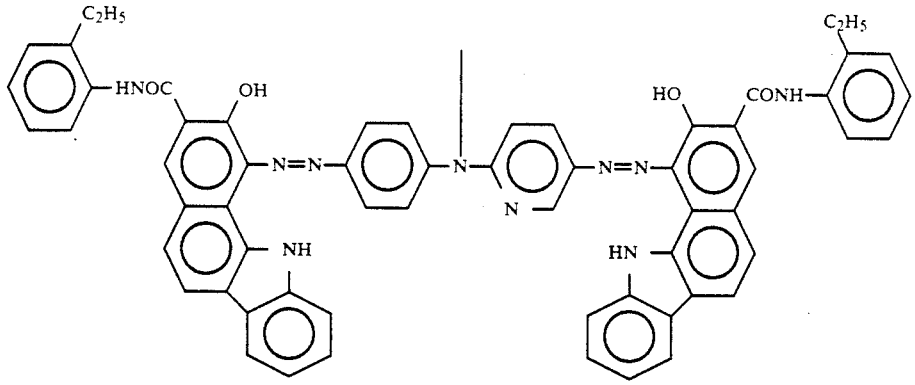
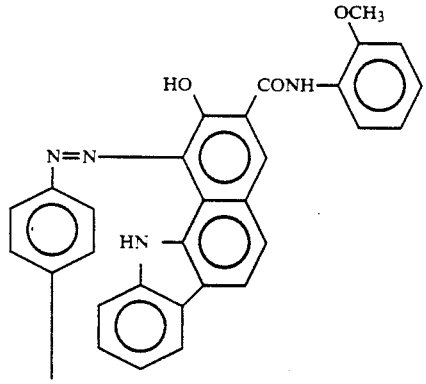
(2)-2
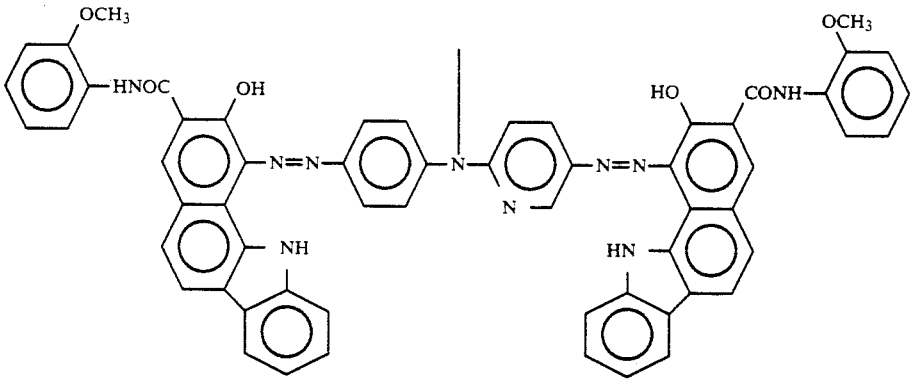
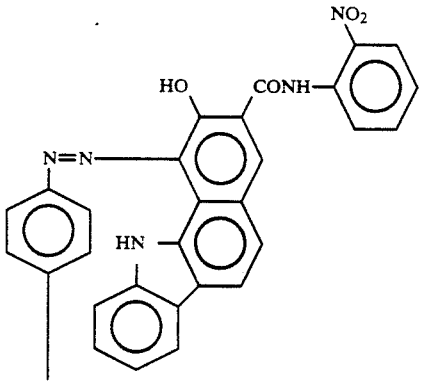
(2)-3

-continued
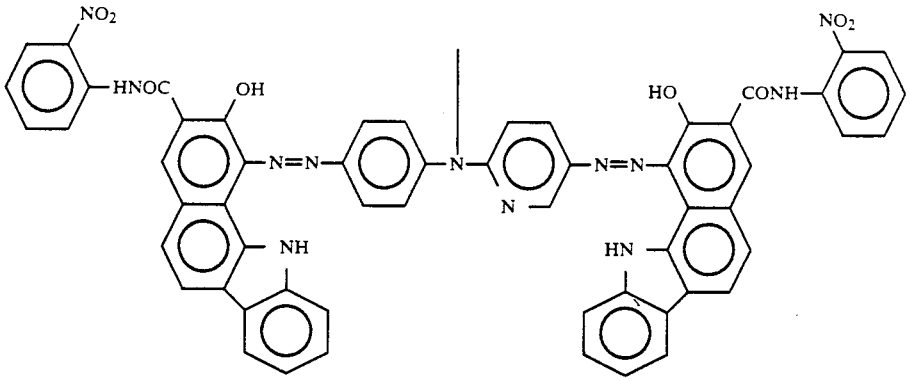
(2)-4
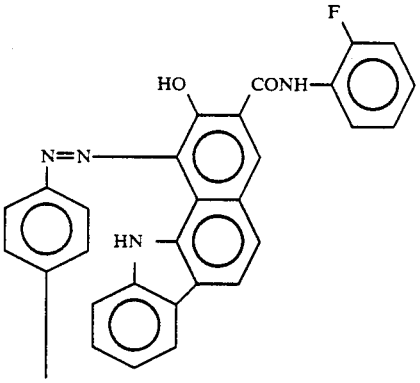
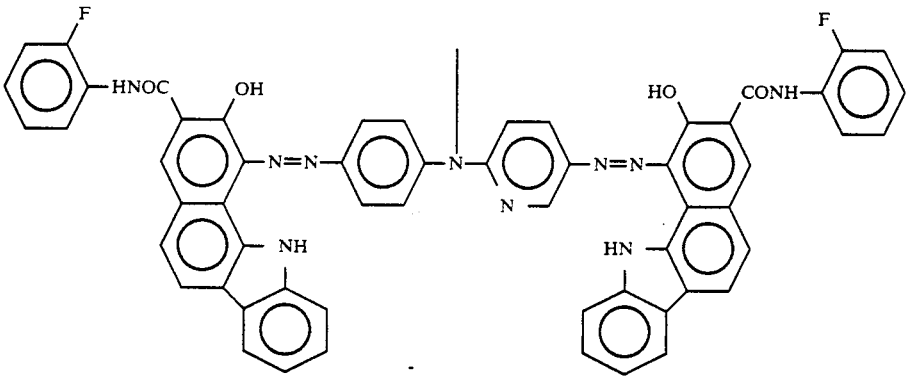
(2)-5
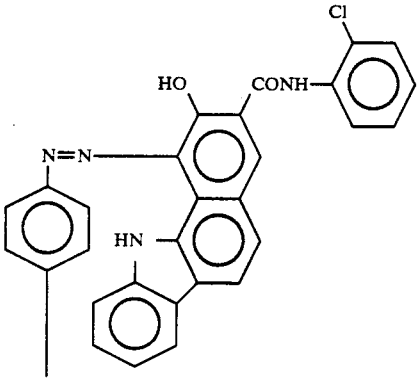

-continued
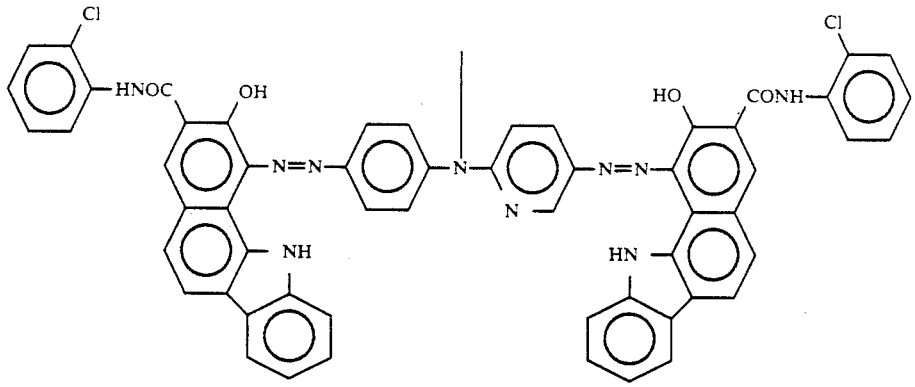
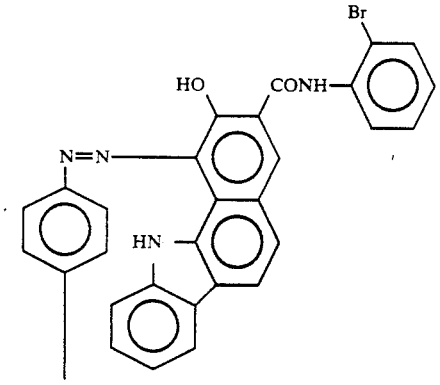
(2)-6
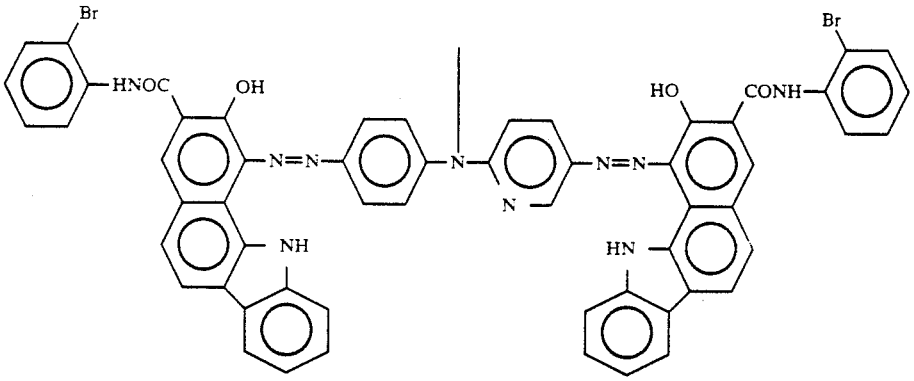
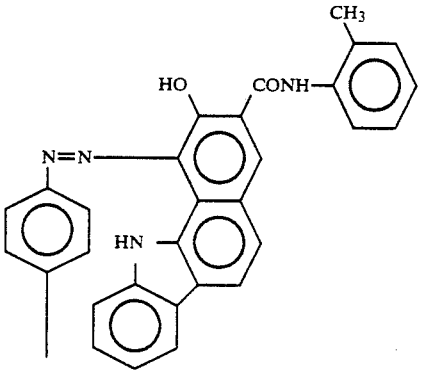
(2)-7

-continued
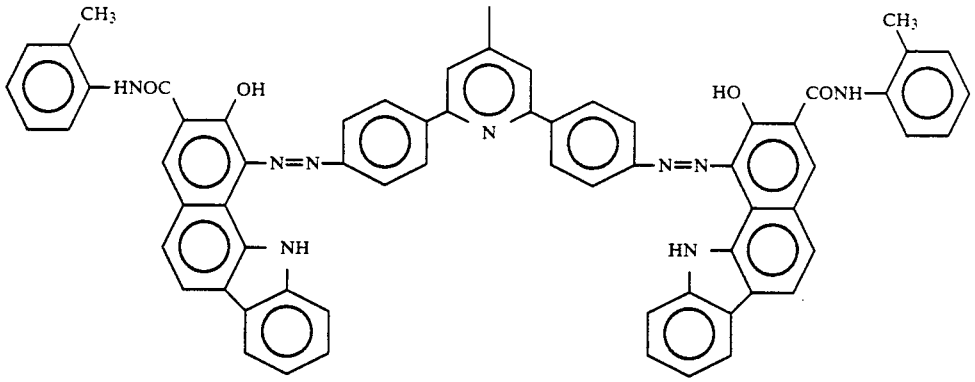
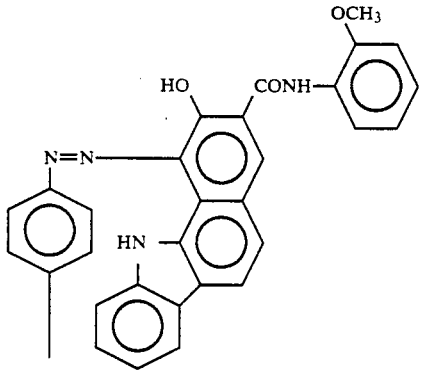
(2)-8
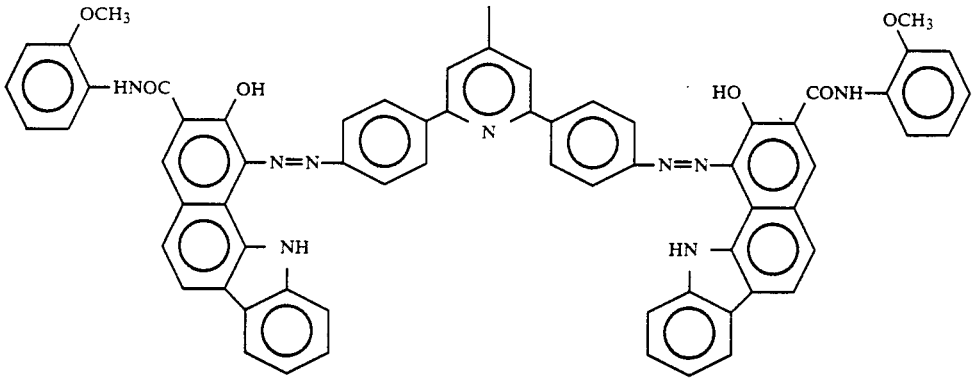
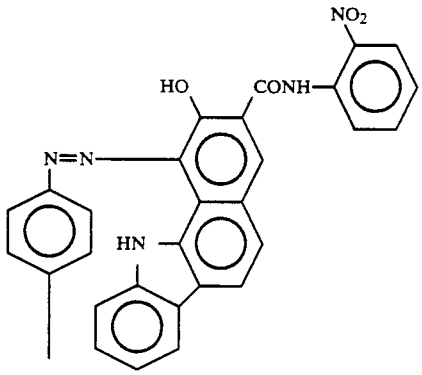
(2)-9

-continued
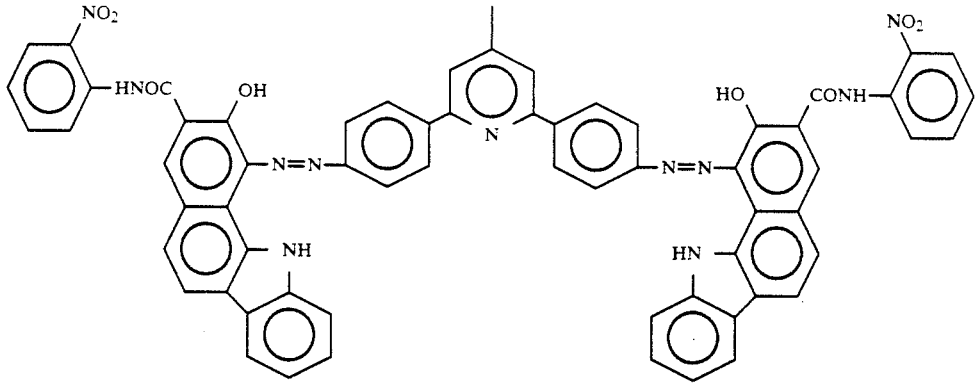
(2)-10
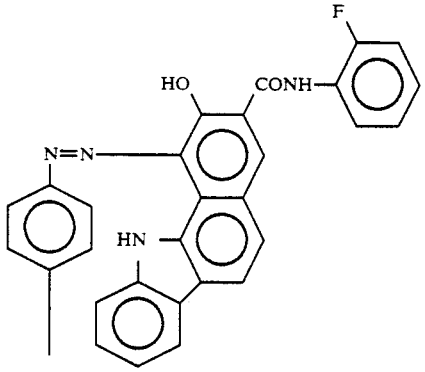
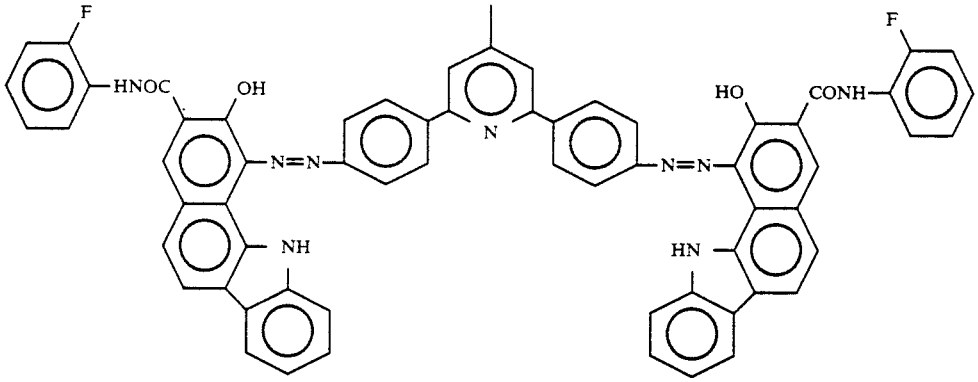
(2)-11
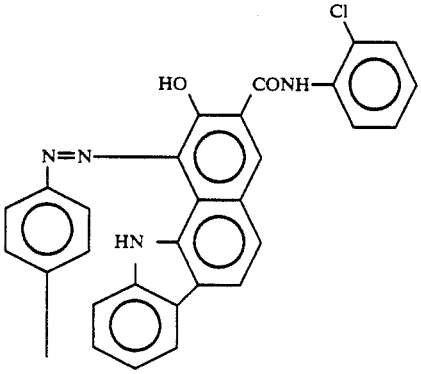

-continued
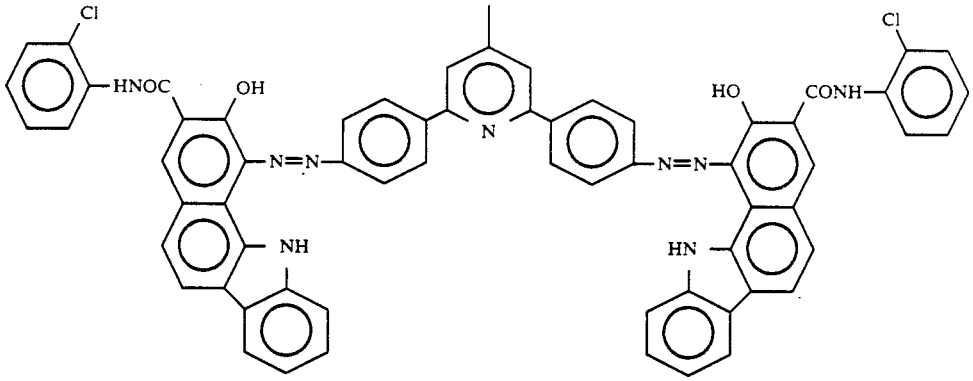
(2)-12
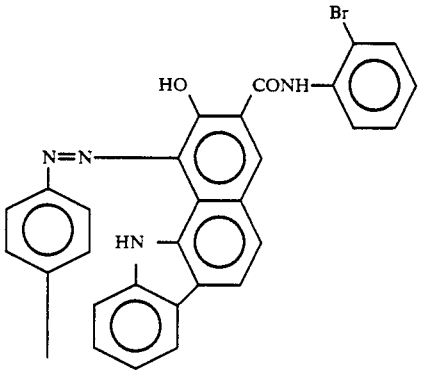
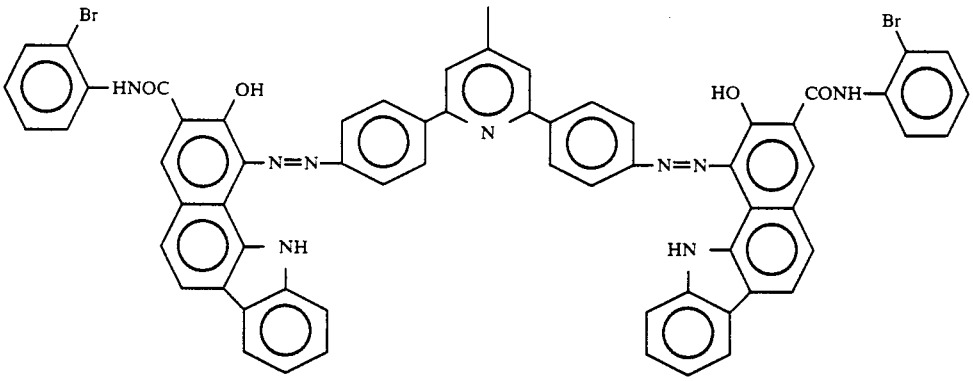
(2)-13
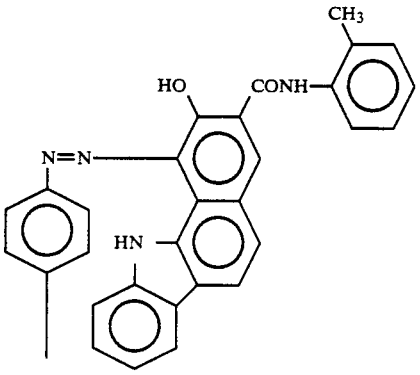

-continued
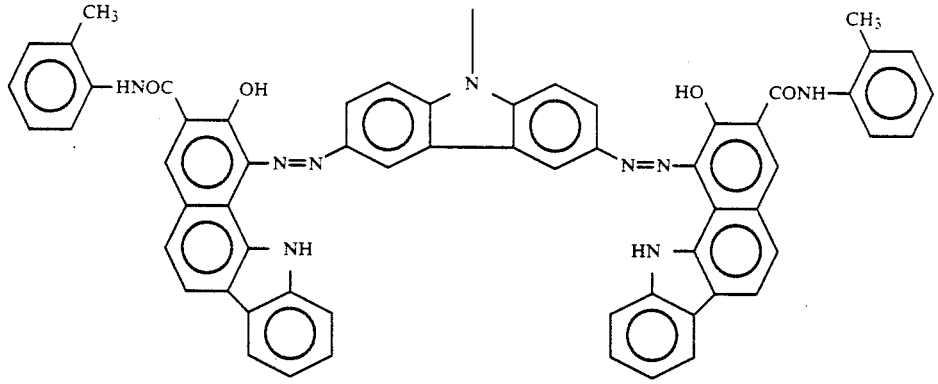
(2)-14
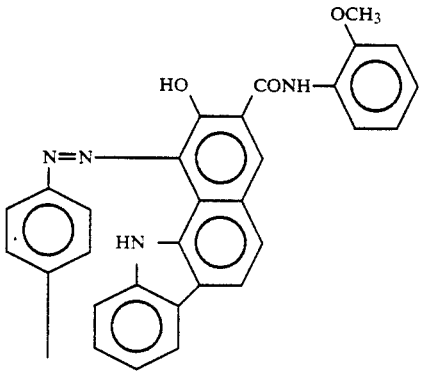
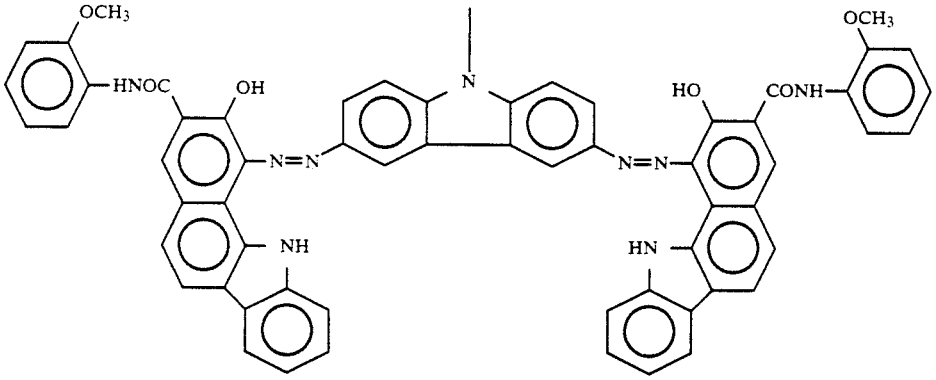
(2)-15
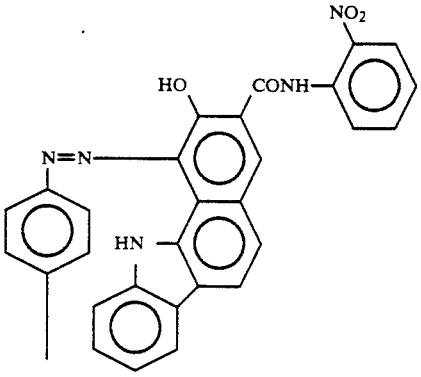

-continued
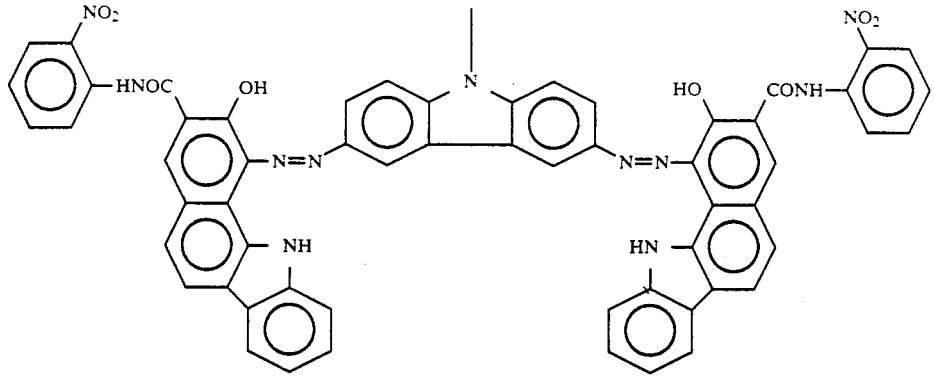
(2)-16
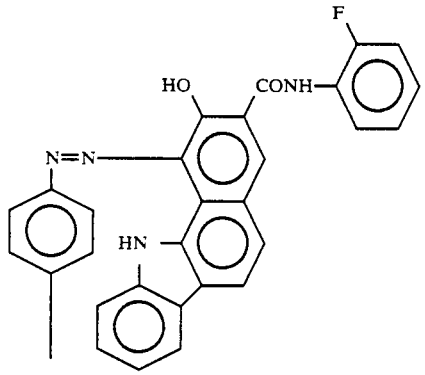
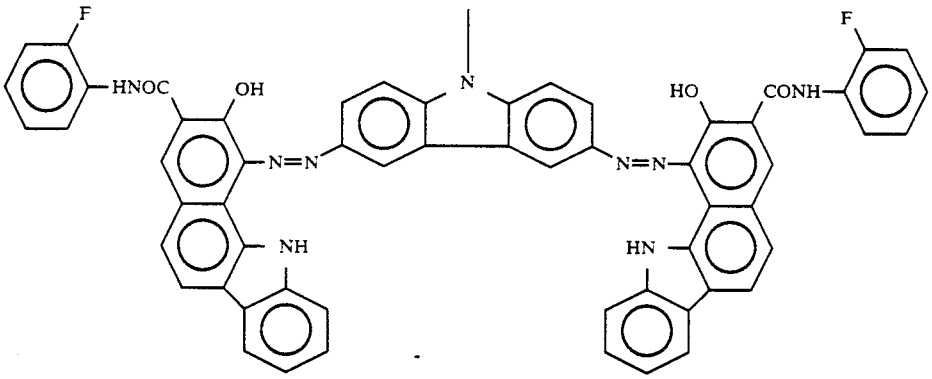
(2)-17
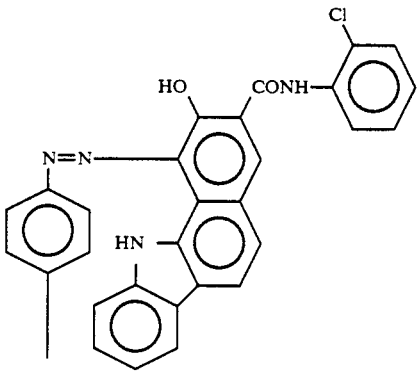

-continued
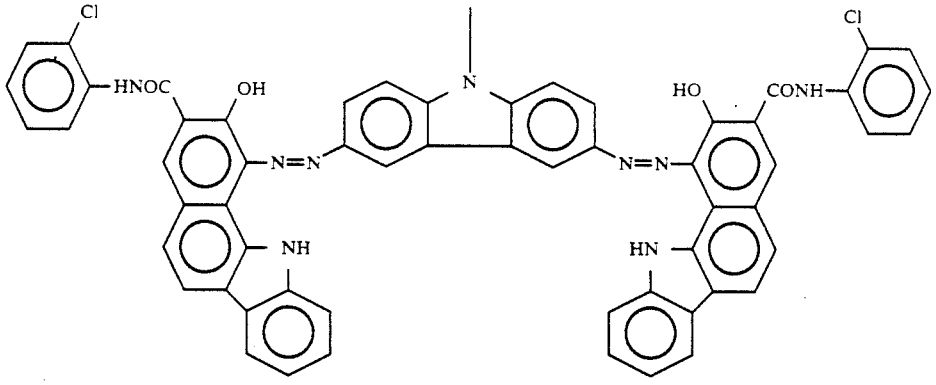
(2)-18
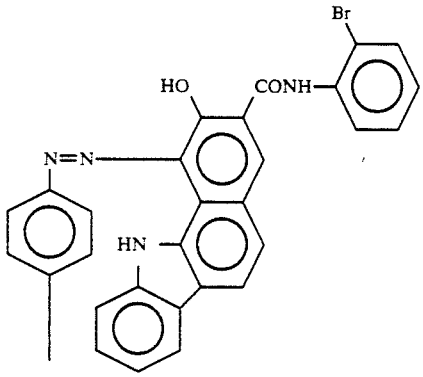
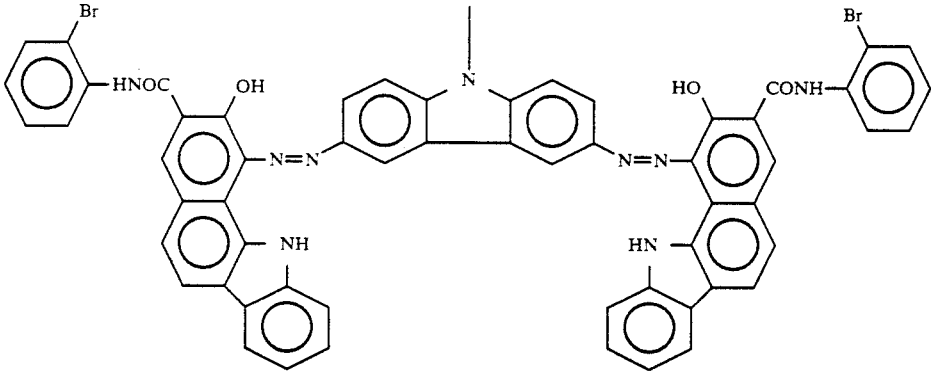
(2)-19
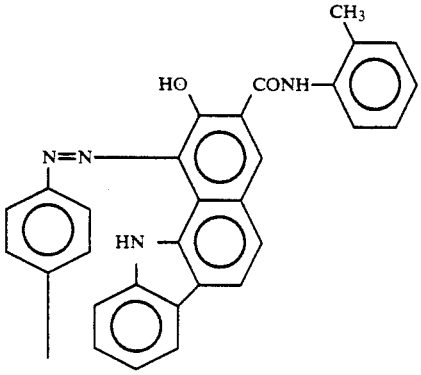

-continued
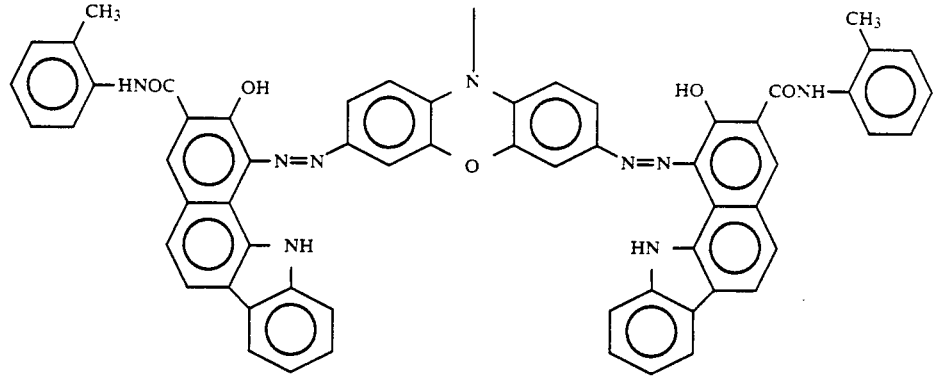
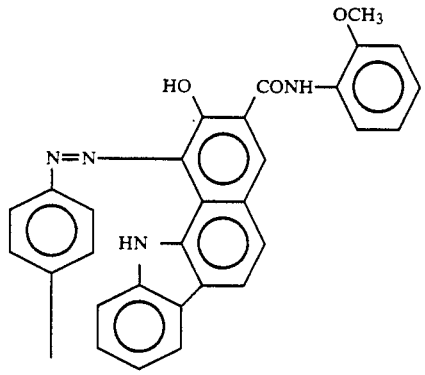
(2)-20
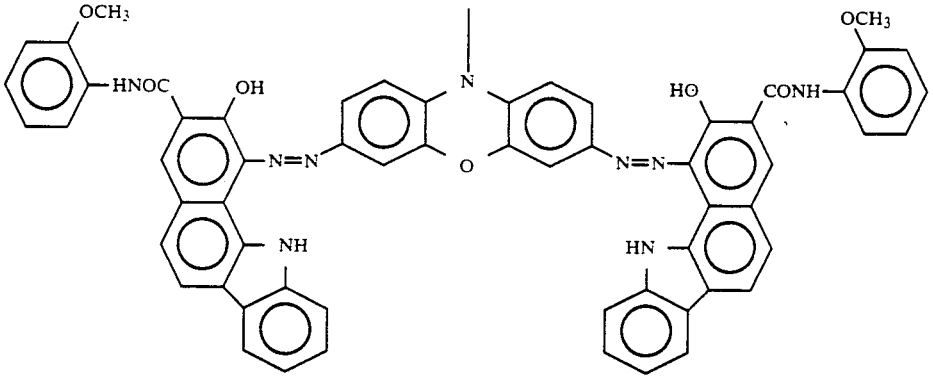
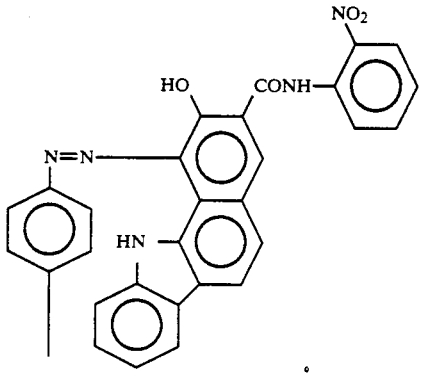
(2)-21

-continued
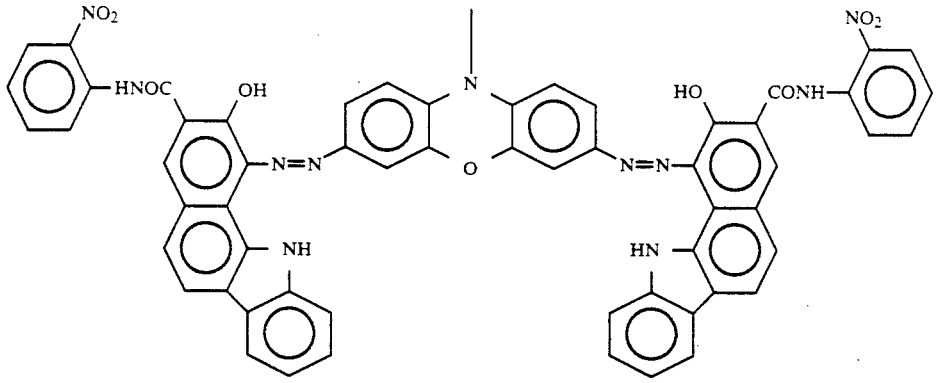
(2)-22
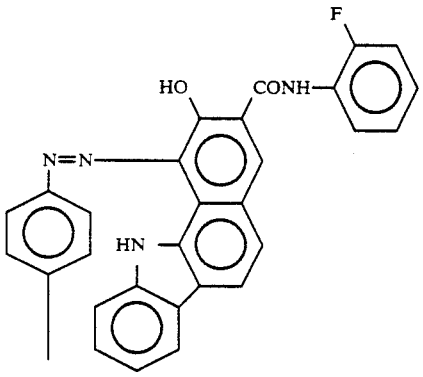
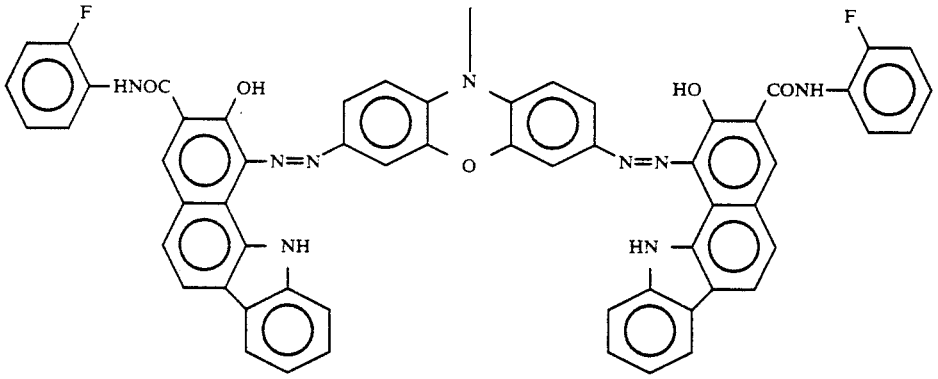
(2)-23
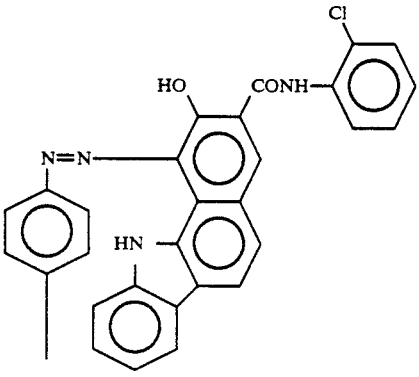

-continued

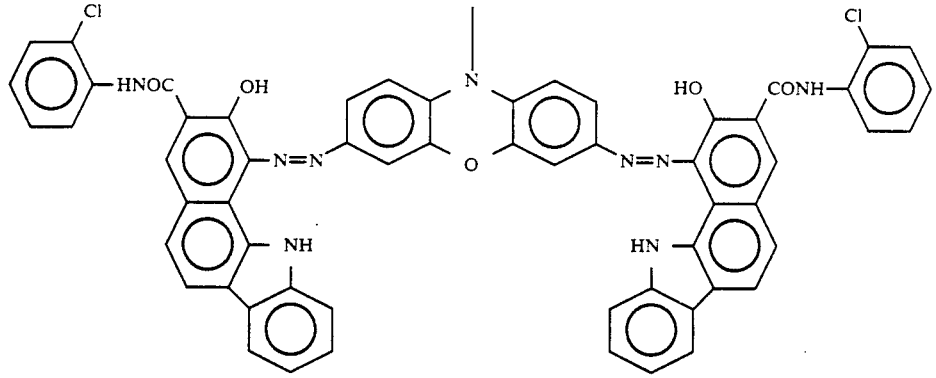

(2)-24

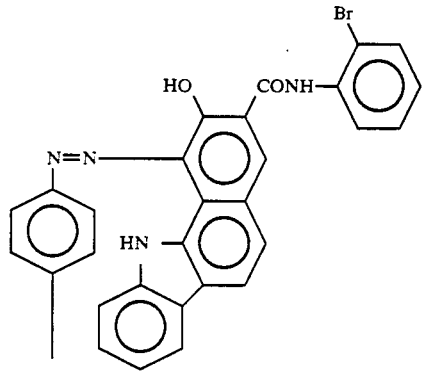

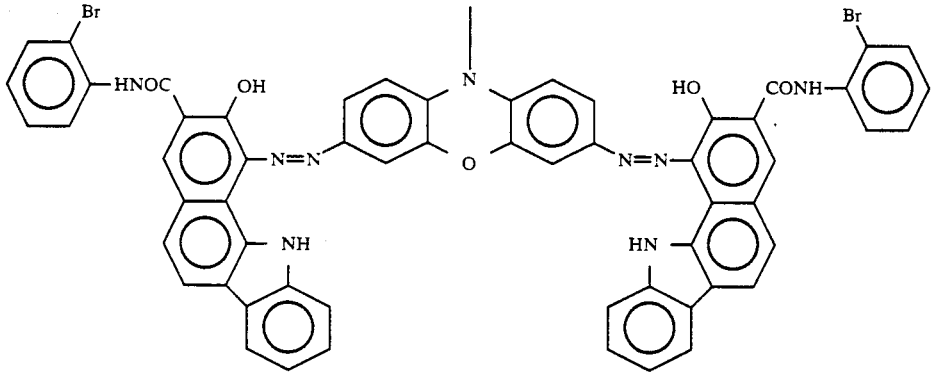

Among the above, Example Compounds (2)-1, (2)-2, (2)-3, (2)-4 and (2)-5 are preferred, and Example Compound (2)-1 is particularly preferred.

The photosensitive layer used in the present invention may assume a so-called single layer structure wherein the above-mentioned charge generating substances and a charge transporting substance are contained in a single layer, or a so-called laminate structure wherein a charge generation layer containing the charge generating substances and a charge transport layer containing a charge transporting substance are laminated, whereas the latter may be preferred. It is further preferred that the charge generation layer assumes a laminate structure including a plurality of layers each containing one of plural charge generating substances used.

In this instance, it is preferred that a layer containing a compound represented by the abovementioned formula (1) showing an excellent sensitivity in a visible region is disposed on a layer containing a compound represented by the above-mentioned formula (2) showing an excellent sensitivity in a longer wavelength region.

Hereinbelow, the electrophotographic photosensitive member of the present invention will be described in further detail with respect to one having a photosensitive layer of a laminate type.

The charge generation layer may be formed by dispersing the compounds represented by the formulae (1) and (2) separately together with an appropriate binder resin and a solvent to form dispersion liquids and applying .the dispersion liquids by spray-coating. In the present invention, it is also possible to use a known charge generating substance in addition to one or both of the above compounds represented by the formulae (1) and (2) in the same or a separate coating liquid.

The binder resin may be selected from a wide variety of insulating resins and organic photoconductive polymers. Examples of the insulating resins may include: polyvinyl butyral, polyarylates (such as a condensation polymer between bisphenol A and phthalic acid), polycarbonate, phenoxy resins, acrylic resins, polyacrylamide resin, polyamides, cellulose resins, urethane resins, epoxy resins, casein, and polyvinyl alcohol. Examples of the organic photoconductive polymers may include: polyvinylcarbazole, polyvinylanthracene and polyvinylpyrene.

The binder resin may preferably be used in a proportion of 80 wt. % or less, particularly 40 wt. % or less, of the total weight of the charge generation layer.

The solvent for constituting the coating liquid for the charge generation layer may be selected in view of the solubility or dispersion stability of the region and charge generating substances used and may be ordinarily selected from alcohols, sulfoxides, ethers, esters, aliphatic halogenated hydrocarbons, and aromatic compounds.

The charge generation layer may have a total thickness of 5 microns less, particularly 0.01–2 microns. This corresponds to a dry coating rate of about 10 $mg/m^2$–2000 $mg/m^2$.

The charge generation layer may be formed by spray coating preferably by using plural sprayers each for a charge generating substance. Examples of such a coating apparatus using plural sprayers are shown in FIGS. 1 and 2.

Referring to these figures, sprayers 1 and 2 are supplied with coating liquids containing different charge generating substances showing excellent sensitivities in mutually different wavelength regions. The sprayers 1 and 2 are respectively designed to provide a spray state, a discharge rate and a discharge angle which can be adjusted as desired. The sprayers 1 and 2 are moved vertically by an elevator 3. Further, an electroconductive substrate may be rotated in the direction of an arrow so that uniform and appropriate coating may be always effected. This apparatus can provide a coating film of an arbitrary type which can be suitably used as a photosensitive layer.

Figure 2:
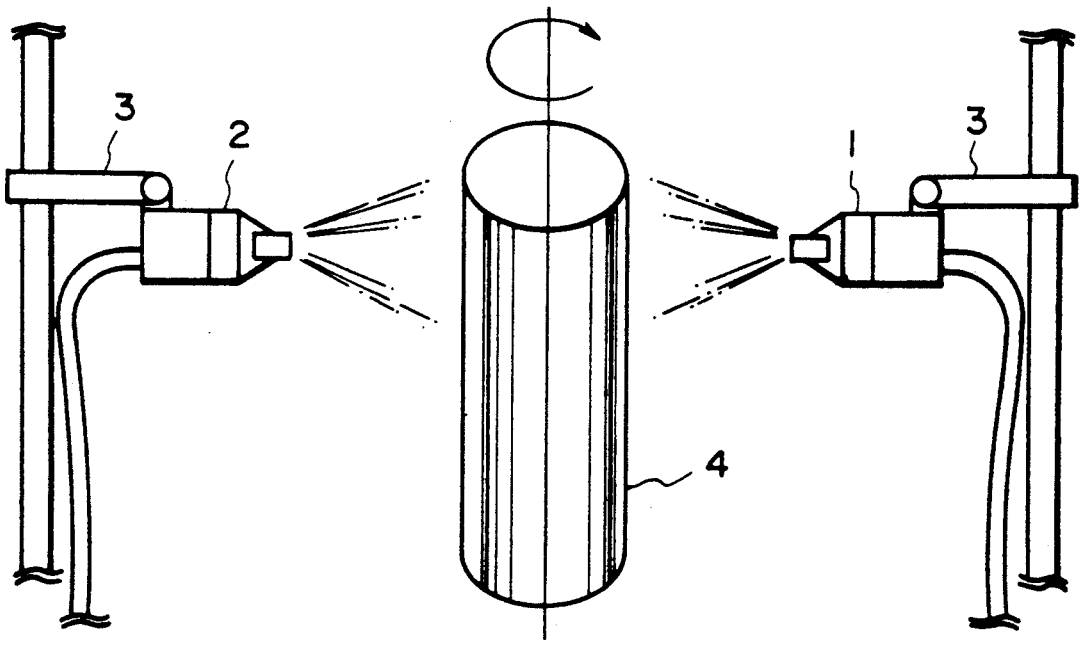
FIG. 2 illustrates another example of coating apparatus for producing an electrophotographic photosensitive member according to the invention.

For example in the coating apparatus shown in FIG. 1, the sprayers 1 and 2 may be set so that the coating liquids from these sprayers are completely free from mixing with each other before and after they reach the electroconductive substrate 4, thereby to form two laminated coating layers free from mixing. Alternatively, the sprayers 1 and 2 may be set so that the coating liquids therefrom are completely mixed with each other before they reach the electroconductive substrate 4 to provide a single layer containing both of the two charge generating substances. It is of course possible to form a layer which has an intermediate characteristic between a single layer and a laminate layer. Further, in case where the coating apparatus shown in FIG. 2 is used, it is even possible to form a laminate structure including more than two coating layers by rotating the electroconductive substrate 4 at an appropriate speed.

Thus, according to the present invention, plural charge generating substances need not be mixed before coating so that it is possible to prevent the above-mentioned difficulty, i.e., inferior performances of a photosensitive layer due to factors, such as agglomeration of different charge generating substances, precipitation of the charge generating substances thereby, roughening of the photosensitive layer and crystal modification of the charge generating substances. It is also possible to control the electrophotographic performances of the photosensitive layer by forming various types of layer structures as described above including a single layer, laminated layers and an intermediate layer.

The charge transport layer may be formed by dissolving a charge transporting substance and a binder resin in an appropriate solvent as desired and applying the resultant coating liquid. Examples of the charge transporting substance usable in the present invention may include: hydrazone compounds, stilbene compounds, pyrazoline compounds, oxazole compounds, thiazole compounds and triaryl amine compounds. These charge transporting substances may be used singly or in combination of two or more species.

Examples of the binder resin for the charge transport layer may include: phenoxy resins, polyacrylamide, polyvinyl butyral, polyarylate, polysulfone, polyamides, acrylic resins, acrylonitrile resins, methacrylic resins, vinyl chloride resins, phenolic resins, epoxy resins, polyesters, alkyd resins, polycarbonate, polyurethane, and copolymers including two or more types of recurring units contained in the above resins, such as styrenebutadiene copolymer, styrene-acrylonitrile copolymer, and styrene-maleic acid copolymer. It is also possible to use a binder resin from organic photoconductive polymers, such as poly-N-vinylcarbazole, polyvinylanthracene and polyvinylpyrene.

The binder resin may preferably be used in a proportion of 90 wt. % or less, particularly 60 wt. % or less, of the total weight of the charge transport layer.

The charge transport layer may preferably have a thickness of 5–40 microns, particularly 10–30 microns.

In the present invention, it is possible form a so-called protective layer comprising a resin layer or a resin layer containing an electroconductive substance on the photosensitive layer so as to protect the photosensitive layer from various mechanical and electrical external forces.

It is further possible in the present invention to form a so-called undercoating layer having a barrier function between the electroconductive substrate and the photosensitive layer.

These various layers other than the charge generation layer may be formed by various coating methods, such as dip coating, spinner coating, wire bar coating, spray coating and blade coating.

The electroconductive substrate may be a substrate or supporting material which per se comprises an electroconductive material, such as aluminum, aluminum alloy, stainless steel, or titanium; an electroconductive substrate as described above or a plastic substrate coated with a film of aluminum, aluminum alloy, indium oxide-tin oxide composite, etc., by vapor deposition; a plastic or paper substrate coated or impregnated with a mixture of electroconductive particles (e.g., carbon black and tin oxide particles) with an appropriate binder; or a plastic which per se has an electroconductivity.

Hereinbelow, the present invention will be described more specifically based on Examples and Comparative Examples wherein "parts" indicating formulations are by weight.

EXAMPLE 1

100 parts of electroconductive powder obtained by coating titanium oxide powder with 75 wt. % of antimony oxide was added to a solution comprising 100 parts of a resol-type phenolic resin (trade name: "PLIOPHEN J-325", mad. by Dai Nippon Ink K.K.), 30 parts of methanol and 100 parts of methyl cellosolve, and the mixture was subjected to sufficient dispersion by means of a ball mill to form a paint for an electroconductive undercoating layer.

The paint was applied onto an aluminum cylinder (80 mm-dia. × 360 mm-length) by dipping, followed by curing under heating at 140° C. for 30 min., to form a 20 micron-thick undercoating layer.

On the undercoating layer, a coating liquid obtained by dissolving 1 part of polyamide resin (trade name: "AMILAN CM-8000", mfd. by Toray K.K.) and 3 parts of 8-nylon resin (trade name: "TORESIN EF-30T", mfd. by Teikoku Kagaku Sangyo K.K.) in a solvent comprising 50 parts of methanol and 40 parts of butanol was applied by dipping to form a 0.5 micron-thick undercoating layer.

Then, 2.5 parts of a disazo pigment of the above-mentioned formula (1)-2 was mixed with a solution of 1.0 part of polyvinyl butyral resin (trade name: "SLEC BL-S", mfd. by Sekisui Kagaku K.K.) in 70 parts of cyclohexanone, and the resultant mixture was subjected to dispersion for 2 hours by means of a sand mill using 1 mm-dia. glass beads to form a dispersion, which was then diluted with 300 parts of cyclohexanone and 300 parts of methyl ethyl ketone to prepare a paint for spray coating (a paint (1) for charge generation layer).

Similarly, 2.5 parts of a trisazo pigment of the above-mentioned formula (2)-1 was mixed with a solution of 1.0 part of polyvinyl butyral resin in 70 parts of cyclohexanone, and the resultant mixture was subjected to dispersion for 2 hours by means of a sand mill using 1 mm-dia. glass beads to form a dispersion, which was then diluted with 300 parts of cyclohexanone and 300 parts of methyl ethyl ketone to prepare a paint for spray coating (a paint (2) for charge generation layer).

The above-prepared paints (1) and (2) were applied in the order of first the paint (2) and then the paint (1) by using a spray coating apparatus as shown in FIG. 1 at a coating rate of 120 mg/m$^2$ for the paint (1) and 60 mg/m$^2$ for the paint (2) (total coating rate of 180 mg/m$^2$), respectively in terms of a dry weight, followed by drying, to form a laminate charge generation layer.

Separately, a liquid dispersion was prepared by dispersing 10 parts of bisphenol Z-type polycarbonate resin (Mn (number-average molecular weight) = 22,000) and 5 parts of polytetrafluoroethylene powder (trade name: "LUBLON L-2", mfd. by Daikin Kogyo) as a fluorine-containing resin together with 40 parts of monochlorobenzene and 15 parts of tetrahydrofuran for 50 hours by means of a stainless steel ball mill, and into the resultant liquid dispersion, 10 parts of a stilbene compound of the following formula:

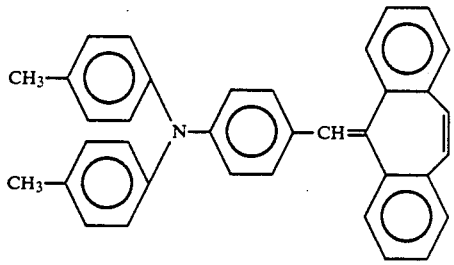

Comparative Compounds 1 as a charge transporting substance was dissolved to form a coating liquid. The coating liquid was applied by dipping onto the above-prepared laminate charge generation layer and then subjected to hot-air drying at 120° C. for 1 hour to form a 26 micron-thick charge transport layer.

The thus-prepared electrophotographic photosensitive member was attached to a plain paper copier also equipped with a laser beam source (trade name: "NP-4835", mfd. by Canon K.K.) and subjected to measurement of a light part potential under irradiation with white light (Vl), a light part potential under irradiation with laser light Vbl), respectively with setting of a dark part potential (Vd) to −650 V, photomemory due to optical fatigue and rest memory characteristic. In this instance, Vl was measured after irradiation at a light quantity of 1.5 lux.sec, Vbl was measured after irradiation with laser light of 802 nm at a power of 8.0 mW, and the photomemory was measured as a difference (=ΔVd) in dark part potential (Vd) between an irradiated part and a non-irradiated part after irradiation of a part of the photosensitive member with white light of 1500 lux for 5 min. Further, the rest memory was measured as a difference (=ΔVd') in dark part potential (Vd) between a part immediately below a corona charger and another part respectively during standing of the photosensitive member after 10000 sheets of image formation and then 10 hours of the standing of the photosensitive member. With respect to both ΔVd and ΔVd', a negative value represents a decrease in absolute value of Vd and a smaller absolute value of ΔVd and ΔVd represents a better result.

The results of the measurement are shown in Table 1 appearing hereinafter together with those of other Examples and Comparative Examples.

EXAMPLES 2–7

Electrophotographic photosensitive members were prepared and evaluated in the same manner as in Example 1 except that Example compounds shown in Table 1 were used instead of the Example Compounds (1)-2 and (2)-1 used in Example 1. The results are also shown in Table 1.

COMPARATIVE EXAMPLES 1–4

Electrophotographic photosensitive members were prepared and evaluated in the same manner as in Example 1 except that Comparative Compounds shown below were used as indicated in Table 1 instead of the Example Compounds (1)-2 and (2)-1 used in Example 1. (Incidentally, in the respective comparative compound pairs shown below, Comparative Compounds 1-b, 2-b, 3-b and 4-b show better sensitivity for a longer wavelength region than Comparative Compounds 1-a, 2-a, 3-a and 4-a, respectively.)

-continued
1-a
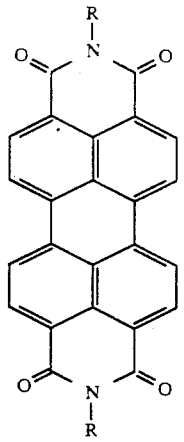
1-b
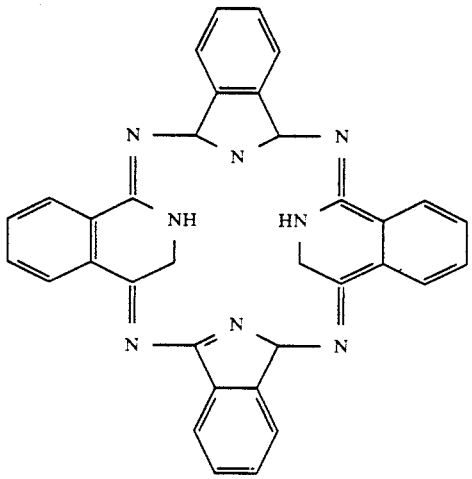
Comparative Compounds 2
2-a
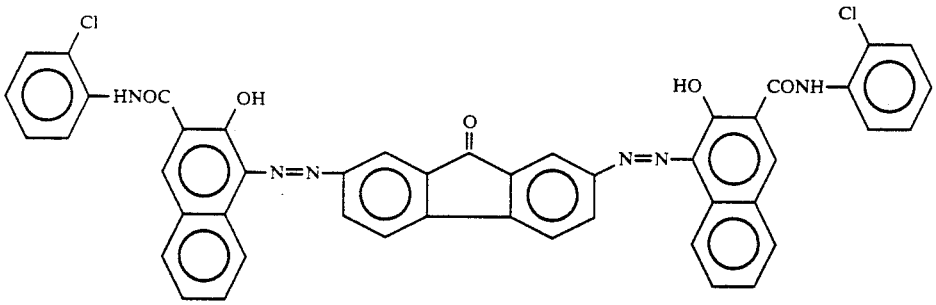
2-b
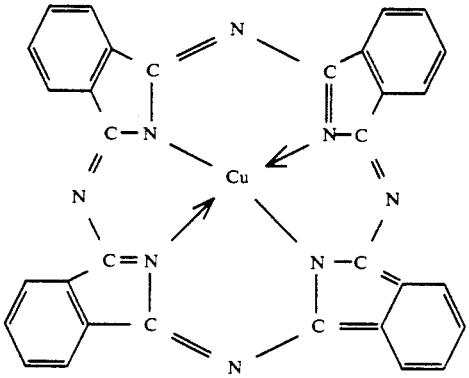

-continued

Comparative Compounds 3

3-a

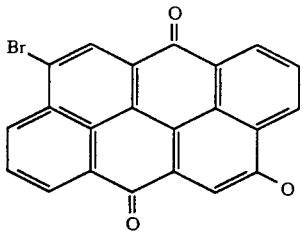

3-b

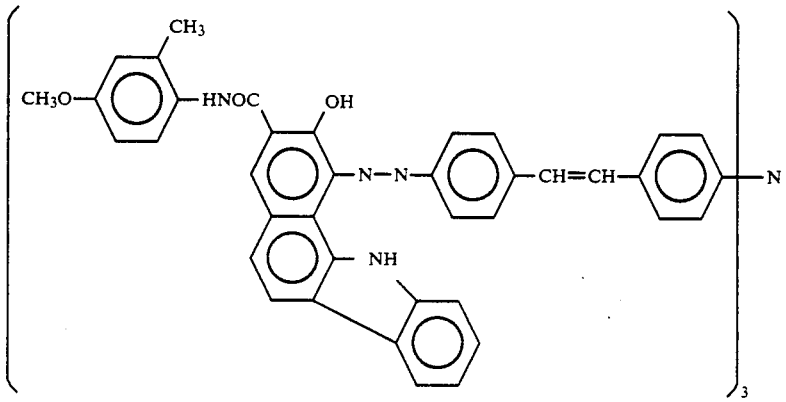

Comparative Compounds 4

4-a

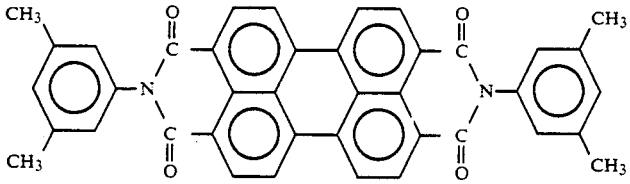

4-b

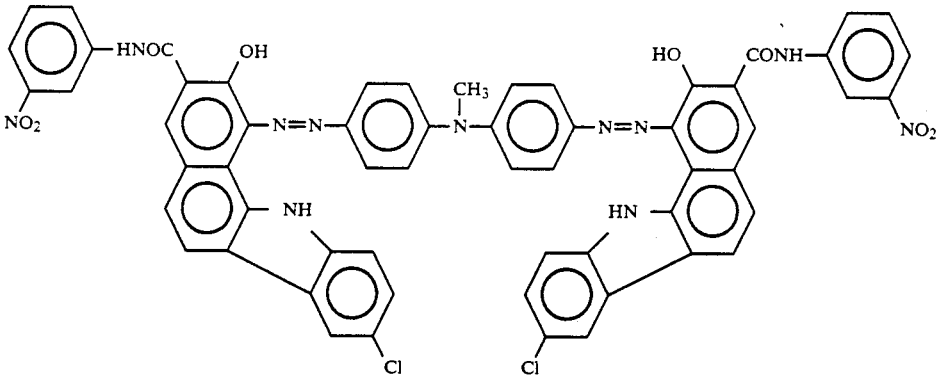

COMPARATIVE EXAMPLE 5

A photosensitive member was prepared and evaluated in the same manner as in Example 1 except that a single charge generation layer was prepared by applying a paint obtained by mixing the paints (1) and (2) for charge generation layer used in Example 1 in advance in a weight ratio of 2:1 so as to provide a dry coating rate of 180 mg/m$^2$. The results are also shown in Table 1.

COMPARATIVE EXAMPLE 6

A photosensitive member was prepared and evaluated in the same manner as in Example 1 except that a laminate charge generation layer was prepared by applying and drying the paint (1) for charge generation layer to form a 0.1 micron-thick first charge generation layer and then applying and drying the paint (2) for charge generation layer to form a 0.1 micron-thick second charge generation layer on the first charge generation layer. The results are also shown in Table 1.

TABLE 1

| | Example Compounds used | | Electrophotographic characteristics | | | | |
|---|---|---|---|---|---|---|---|
| | Upper layer | Lower layer | Vd(−V) | Vl(−V) | Vbl(−V) | ΔVd(V) | ΔVd'(V) |
| Example | | | | | | | |
| 1 | (1)-2 | (2)-1 | 650 | 130 | 70 | −30 | −30 |
| 2 | (1)-2 | (2)-5 | 650 | 130 | 90 | −30 | −40 |
| 3 | (1)-2 | (2)-9 | 650 | 130 | 100 | −30 | −40 |
| 4 | (1)-5 | (2)-1 | 650 | 150 | 70 | −50 | −30 |
| 5 | (1)-8 | (2)-1 | 650 | 150 | 70 | −50 | −30 |
| 6 | (1)-5 | (2)-5 | 650 | 150 | 90 | −50 | −40 |
| 7 | (1)-8 | (2)-9 | 650 | 150 | 100 | −50 | −40 |
| Comparative Example | | | | | | | |
| 1 | 1-a | 1-b | 650 | 280 | 190 | −110 | −80 |
| 2 | 2-a | 2-b | 650 | 170 | 110 | −100 | −90 |
| 3 | 3-a | 3-b | 650 | 210 | 140 | −80 | −90 |
| 4 | 4-a | 4-b | 650 | 250 | 150 | −80 | −150 |
| 5 | (1)-2 and (2)-1 (single layer) | | 650 | 190 | 100 | −60 | −40 |
| 6 | (1)-2 | (2)-1 | 650 | 160 | 100 | −110 | −100 |

EXAMPLE 8

A 20 micron-thick charge transport layer was formed by coating a 50 micron-thick aluminum sheet with a solution prepared by dissolving 10 parts of bisphenol Z-type polycarbonate resin (Mn=22,000) and 10 parts of the stilbene compound used in Example 1 in 60 parts of monochlorobenzene by using a wire bar, followed by 1 hour of hot air drying at 120° C.

The paints (1) and (2) for charge generation layer used in Example 1 were applied on the charge transport layer in the order of first the paint (2) and then the paint (1) by using a spray coating apparatus as shown in FIG. 1 at a coating rate of 180 mg/m$^2$ for the paint (1) and 90 mg/m$^2$ for the paint (2) (total coating rate of 270 mg/m$^2$, respectively in terms of a dry weight, followed by drying, to form a laminate charge generation layer.

Electrophotographic characteristics of the thus-prepared photosensitive member were evaluated by using Paper Analyzer SP-428 (available from Kawaguchi Denki Seisakushô K.K.) so that the photosensitive member was first charged to have a surface potential of +700 V and irradiated at an illuminance of 5 lux with light from a halogen lamp to measure a time in which the surface potential was reduced to +200 V as an evaluation of the sensitivity.

Separately, the photosensitive member was also irradiated with spectral light of 780 nm obtained through an interference filter at an illuminance of 10 mW/m$^2$ to measure a photo-energy by which the surface potential of the photosensitive member was reduced from +700 V to +200 V as another evaluation of the sensitivity.

The results are shown in Table 2 below.

COMPARATIVE EXAMPLE 7

A photosensitive member was prepared and evaluated in the same manner as in Example 8 except that a single charge generation layer was prepared by applying a paint obtained by mixing the paints (1) and (2) for charge generation layer used in Example 1 in advance in a weight ratio of 2:1 so as to provide a dry coating rate of 270 mg/m$^2$. The results are also shown in Table 2.

TABLE 2

| | Sensitivity | |
|---|---|---|
| | to halogen light | to 780 nm |
| Example 8 | 1.8 lux · sec | 1.4 μJ/cm$^2$ |
| Comparative Example 7 | 3.1 lux · sec | 1.6 μJ/cm$^2$ |

What is claimed is:

1. An electrophotographic photosensitive member, comprising: an electroconductive substrate and a photosensitive layer disposed on the electroconductive substrate, wherein the photosensitive layer contains a compound represented by formula (1) below and a compound represented by formula (2) below and has been formed by applying the compounds (1) and (2) respectively by spray-coating through separate spraying means:

Formula (1)

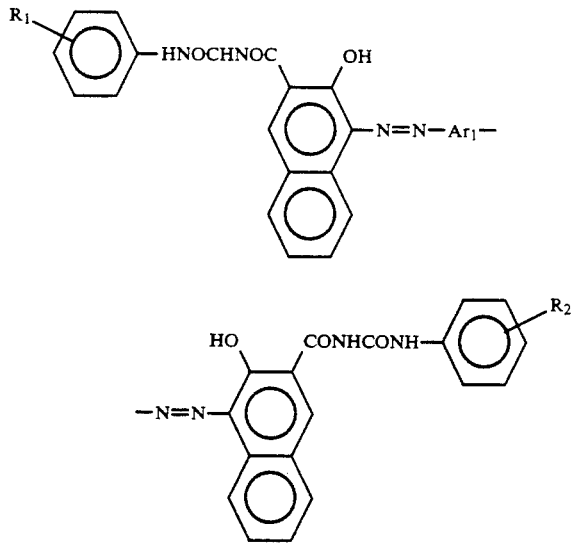

wherein $Ar_1$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_1$ and $R_2$ independently denote hydrogen atom, halogen atom, alkyl group, alkoxy group, nitro group or cyano group;

TABLE 2-continued

| | Sensitivity | |
|---|---|---|
| | to halogen light | to 780 nm |
| Example 7 | | |

Formula (2)

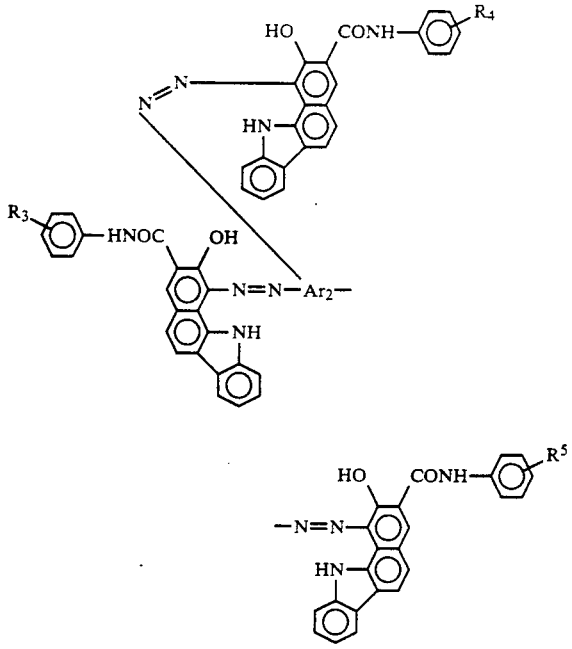

wherein $Ar_2$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_3$, $R_4$ and $R_5$ independently denote hydrogen atom, halogen atom, alkyl group, alkoxy group, nitro group or cyano group.

2. A photosensitive member according to claim 1, wherein said photosensitive layer includes a charge generation layer and a charge transport layer.

3. A photosensitive member according to claim 2, wherein said charge generation layer includes a layer comprising the compound represented by the formula (1) and a layer comprising the compound represented by the formula (2).

4. A photosensitive member according to claim 3, comprising in sequence the electroconductive substrate, the layer comprising the compound represented by the formula (2) and the layer comprising the compound represented by the formula (1).

5. A photosensitive member according to claim 1, comprising a protective layer on the photosensitive layer.

6. A photosensitive member according to claim 1, comprising an undercoating layer between the electroconductive substrate and the photosensitive layer.

7. A process for producing an electrophotographic photosensitive member, comprising:

coating an electroconductive substrate with a compound represented by formula (1) shown below and a compound represented by formula (2) shown below respectively by spray-coating through separate spraying means to form a photosensitive layer containing the compounds represented by the formulae (1) and (2) respectively on the electroconductive substrate:

Formula (1)

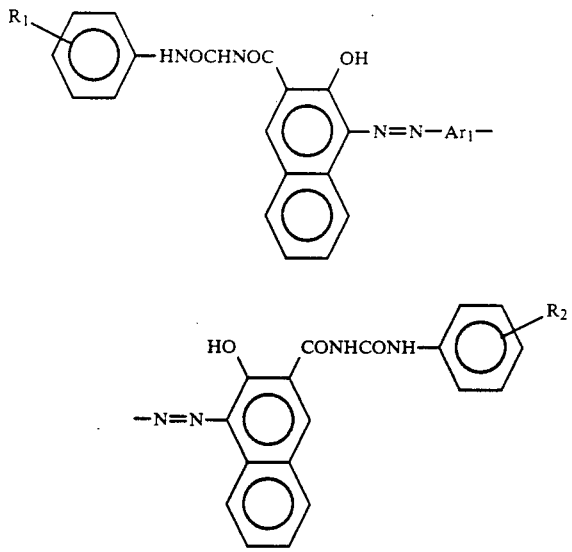

wherein $Ar_1$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_1$ and $R_2$ independently denote hydrocarbon atom, halogen atom, alkyl group, alkoxy group, nitro group or cyano group;

Formula (2)

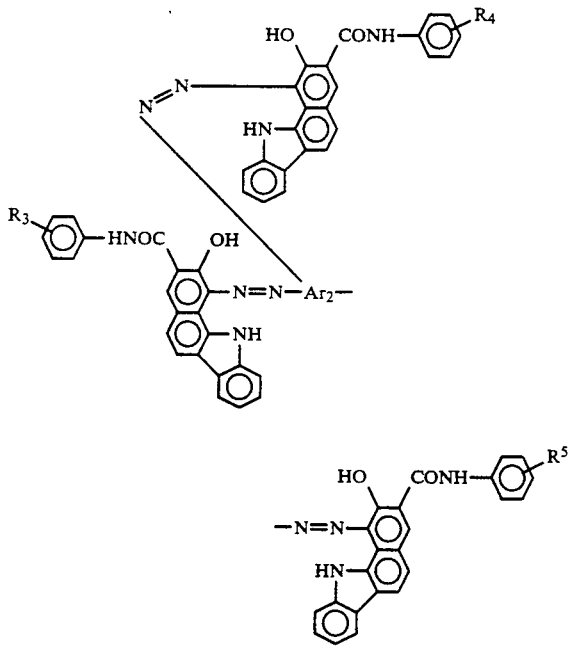

wherein $Ar_2$ denotes an aromatic hydrocarbon ring which may have a substituent, a heterocyclic aromatic ring which may have a substituent, or a ring assembly formed by bonding the aromatic rings directly or through an aromatic or non-aromatic bonding group; and $R_3$, $R_4$ and $R_5$ independently denote hydrogen atom, halogen atom, alkyl group, alkoxy group, nitro group or cyano group.

8. A process according to claim 7, wherein said photosensitive layer includes a charge generation layer and a charge transport layer.

9. A process according to claim 8, wherein said charge generation layer includes a layer comprising the compound represented by the formula (1) and a layer comprising the compound represented by the formula (2).

10. A process according to claim 9, wherein the electrophotographic photosensitive member comprises, in sequence, the electroconductive substrate, the layer comprising the compound represented by the formula (2) and the layer comprising the compound represented by the formula (1).

* * * * *